US008373525B2

(12) United States Patent
Watanabe et al.

(10) Patent No.: US 8,373,525 B2
(45) Date of Patent: Feb. 12, 2013

(54) ELECTROMAGNETIC CONTACTOR

(75) Inventors: Masaaki Watanabe, Konosu (JP); Hideki Daijima, Konosu (JP)

(73) Assignee: Fuji Electric FA Components & Systems Co., Ltd., Tokyo (JP)

( * ) Notice: Subject to any disclaimer, the term of this patent is extended or adjusted under 35 U.S.C. 154(b) by 300 days.

(21) Appl. No.: 12/659,048

(22) Filed: Feb. 24, 2010

(65) Prior Publication Data

US 2010/0245002 A1 Sep. 30, 2010

(30) Foreign Application Priority Data

Mar. 30, 2009 (JP) ..... 2009-081727

(51) Int. Cl.
*H01H 3/00* (2006.01)

(52) U.S. Cl. ..... 335/185; 335/195; 335/251

(58) Field of Classification Search ..... 335/185–195, 335/250–251, 257
See application file for complete search history.

(56) References Cited

U.S. PATENT DOCUMENTS

| | | | | |
|---|---|---|---|---|
| 4,513,270 | A * | 4/1985 | Belbel et al. | 335/195 |
| 4,734,669 | A * | 3/1988 | Maenishi et al. | 335/132 |
| 6,292,075 | B1 * | 9/2001 | Connell et al. | 335/185 |

FOREIGN PATENT DOCUMENTS

| | | | |
|---|---|---|---|
| JP | S61-171023 | | 8/1986 |
| JP | 10188765 | A * | 7/1998 |
| JP | H10-188765 | | 7/1998 |
| JP | H11-003645 | | 1/1999 |

OTHER PUBLICATIONS

Machine translation of JP 10188765 A dated Jul. 1998.*

* cited by examiner

*Primary Examiner* — Bernard Rojas
(74) *Attorney, Agent, or Firm* — Manabu Kanesaka

(57) ABSTRACT

An electromagnetic contactor has a stationary core; a coil arranged around the stationary core; a movable holder movable toward the stationary core; a movable core coupled to one end of the movable holder for being attracted to the stationary core by the excitation of the coil; and a nonmagnetic structural component arranged on the movable core facing the stationary core. The nonmagnetic structural component is a flat plate structural component with high flexural rigidity, overlaid on the surface of the movable core to face the stationary core. The nonmagnetic structural component and the movable core are held between a cushioning spring and a coupling pin. The cushioning spring is contained in the movable holder and buts the back face of the movable core not facing the stationary core. The coupling pin crosses the nonmagnetic structural component with both ends engaged with a pair of holder legs.

7 Claims, 7 Drawing Sheets

ELECTROMAGNETIC CONTACTOR

BACKGROUND OF THE INVENTION AND RELATED ART STATEMENT

The present invention relates to an electromagnetic contactor carrying out switching of a current supplied to an electric load device such an electric motor and particularly to an electromagnetic contactor having a DC electromagnet with a nonmagnetic structural component mounted between a movable core and a stationary core.

An electromagnetic contactor is a device with a stationary core, a movable core arranged opposite to the stationary core and a coil arranged around the periphery of a main leg of the stationary core contained in an insulating case. With the coil excited to attract the movable core to the stationary core, a movable contact and a stationary contact are electrically connected. In an electromagnetic contactor having a DC electromagnet with a nonmagnetic structural component mounted between a movable core and a stationary core, as disclosed in JP-A-10-188765, the nonmagnetic structural component is attached to the bottom end surface of the movable core opposite to the top end surface of the stationary core for preventing the movable core from being attracted to the stationary core by residual magnetism due to magnetization retained in the stationary core even after the excitation of the coil is stopped.

The nonmagnetic structural component attached to the bottom end surface of the movable core disclosed in JP-A-10-188765 is shown in FIGS. 7A to 7C. FIG. 7A is a perspective view showing a nonmagnetic plate 2 as the nonmagnetic structural component integrally provided with a covering part 2*a* covering the whole bottom surface of the movable core 1 and two engaging parts 2*b* each engaging with the upper part of the movable core 1. FIG. 7B is a perspective view showing a nonmagnetic plate 3 as the nonmagnetic structural component in the shape of a frame surrounding the peripheral side face of the movable core 1. The movable core 1 and the nonmagnetic plate 3 are held between cushioning springs 4 each disposed on the top face of the movable core 1 and a coupling pin 6 arranged across the bottom face of the movable core 1. FIG. 7C is a perspective view showing a nonmagnetic plate 5 as the nonmagnetic structural component in the shape of a flat plate stuck onto the bottom face of the movable core 1 by an insulating adhesive.

[Patent Document 1] JP-A-10-188765

However, the electromagnetic contactor provided with each of the nonmagnetic plates 2, 3 and 5 disclosed in JP-A-10-188765 has a problem in a product cost. Namely, each of the nonmagnetic plates 2 and 3 shown in FIGS. 7A and 7B, respectively, is a structural component with a shape more complicated compared with the shape of the nonmagnetic plate 5 shown in FIG. 7C provided as a flat plate structural component to cause a high component unit price, by which there is a possibility of increasing the product cost of the electromagnetic contactor.

Moreover, the nonmagnetic plate 5 shown in FIG. 7C takes much time in sticking it onto the movable core 1 by using an adhesive to increase labor cost, which will cause possible increase in the product cost of the electromagnetic contactor.

Accordingly, it is an object of the invention to prepare a nonmagnetic structural component with a simple shape and also reduce the labor cost in attaching the nonmagnetic structural component onto the bottom face of a movable core to thereby provide an electromagnetic contactor in which the product cost can be made reduced.

Further objects and advantages of the invention will be apparent from the following description of the invention.

SUMMARY OF THE INVENTION

For achieving the above object, an electromagnetic contactor according to the invention includes a stationary core, a coil arranged around the stationary core, a movable holder arranged movably toward the stationary core, a movable core coupled to one end of the movable holder in proximity to the stationary core for being attracted to the stationary core by the excitation of the coil, and a nonmagnetic structural component arranged on the movable core on the side of facing the stationary core. In the electromagnetic contactor, the nonmagnetic structural component is prepared as a flat plate structural component with high flexural rigidity. The nonmagnetic structural component is arranged to be overlaid on the surface of the movable core which surface faces the stationary core, and the nonmagnetic structural component and the movable core are held between a cushioning spring and a coupling pin. The cushioning spring is contained in the movable holder and butting against the back face of the movable core not facing the stationary core. The coupling pin is arranged across the nonmagnetic structural component with both ends made engaged with a pair of holder legs, respectively, of the movable holder provided on the side facing the stationary core.

According to the invention, a nonmagnetic plate as the nonmagnetic structural component is a flat plate structural component overlaid on the movable core. This allows the unit price of the nonmagnetic plate to be set lower compared with those of the related nonmagnetic plates with the complicated shapes, which enables reduction in product cost of the electromagnetic contactor. In addition, the nonmagnetic plate overlaid on the bottom face of the movable core of the invention forms a structure in which the nonmagnetic plate is held together with the movable core between the cushioning spring and the coupling pin provided across the nonmagnetic plate with both ends of the pin made engaged with a pair of the holder legs, respectively. This eliminates the need of the work of sticking the nonmagnetic plate onto the movable core to reduce the man-hours of work required for assembling the electromagnetic contactor, which enables reduction in product cost of the electromagnetic contactor.

Furthermore, in the electromagnetic contactor according to the invention, the nonmagnetic plate is provided with a guide that restricts the shift of the nonmagnetic plate toward the movable holder side along the surface of the movable core.

An impactive force, exerted on a nonmagnetic plate when the nonmagnetic plate butts against the stationary core with the movable core attracted to the stationary core, also acts in the direction along the bottom face of the movable core. Under normal circumstances, this generally causes a nonmagnetic plate without being stuck onto a movable core, to shift in the direction along the bottom face of the movable core and repeat collisions with the movable holder and a pair of the holder legs. The collisions result in possible wear or damage of the movable holder and a pair of the holder legs. The nonmagnetic plate according to the invention, however, is provided with the guide, by which the shifts of the nonmagnetic plate toward movable holder and a pair of the holder legs are restricted to prevent the nonmagnetic plate from collisions with the movable holder and a pair of the holder legs. Thus, the wear or damage of the movable holder and a pair of the holder legs can be inhibited.

Moreover, in the electromagnetic contactor according to an embodiment of the invention, the guide is formed as a pair of protrusions each being formed to protrude outside from the edge of the nonmagnetic plate and surrounding the inner wall side of each of a pair of the holder legs with a slight clearance provided from the inner wall.

According to the invention, the protrusions, each being formed to protrude outside from the edge of the nonmagnetic plate and surrounding the inner wall side of each of a pair of the holder legs with a slight clearance provided from the inner wall, and to restrict the shifts of the nonmagnetic plate toward the movable holder and a pair of the holder legs to prevent the nonmagnetic plate from collisions with the movable holder and a pair of the holder legs. Thus, the wear or damage of the movable holder and a pair of the holder legs can be inhibited with a simple structure.

In the electromagnetic contactor according to the invention, a nonmagnetic plate as the nonmagnetic structural component is a flat plate structural component overlaid on the movable core. This allows the unit price of the nonmagnetic plate to be set lower compared with those of the related nonmagnetic plates with the complicated shapes, which enables reduction in product cost of the electromagnetic contactor. In addition, the nonmagnetic plate overlaid on the bottom face of the movable core of the invention forms a structure in which the nonmagnetic plate is held together with the movable core between the cushioning spring and the coupling pin provided across the nonmagnetic plate with both ends of the pin made engaged with a pair of the holder legs, respectively. This eliminates the need of the work of sticking the nonmagnetic plate onto the movable core to reduce the man-hours of work required for assembling the electromagnetic contactor, which enables reduction in product cost of the electromagnetic contactor.

DETAILED DESCRIPTION OF PREFERRED EMBODIMENTS

In the following, an embodiment of the electromagnetic contactor according to the invention, namely an electromagnetic contactor having a DC electromagnet with a nonmagnetic structural component mounted between a movable core and a stationary core, will be explained in detail with reference to the attached drawings.

Figure 1:
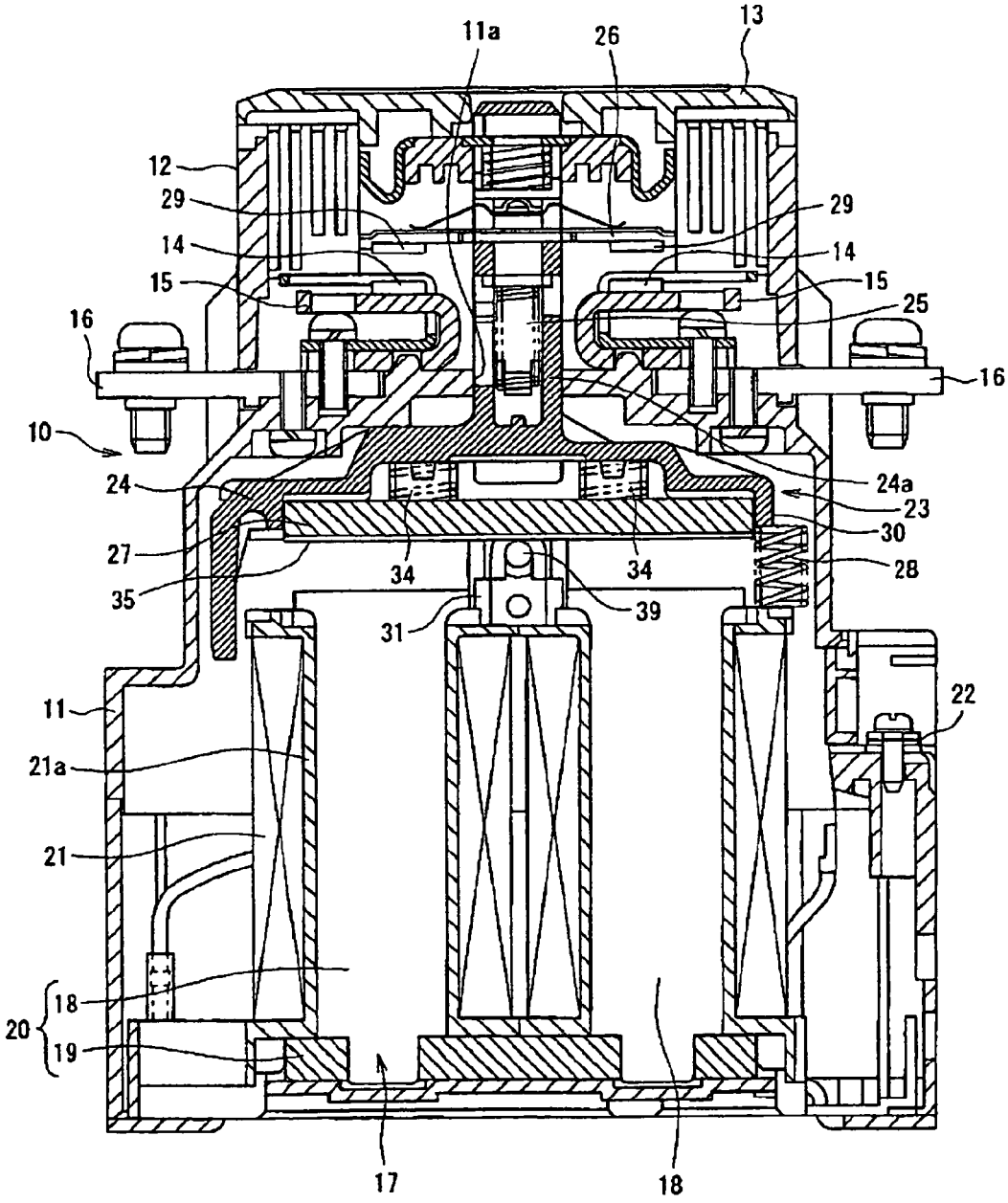
FIG. 1 is a cross sectional view showing an embodiment of an electromagnetic contactor according to the invention in an open state.
Figure 2:
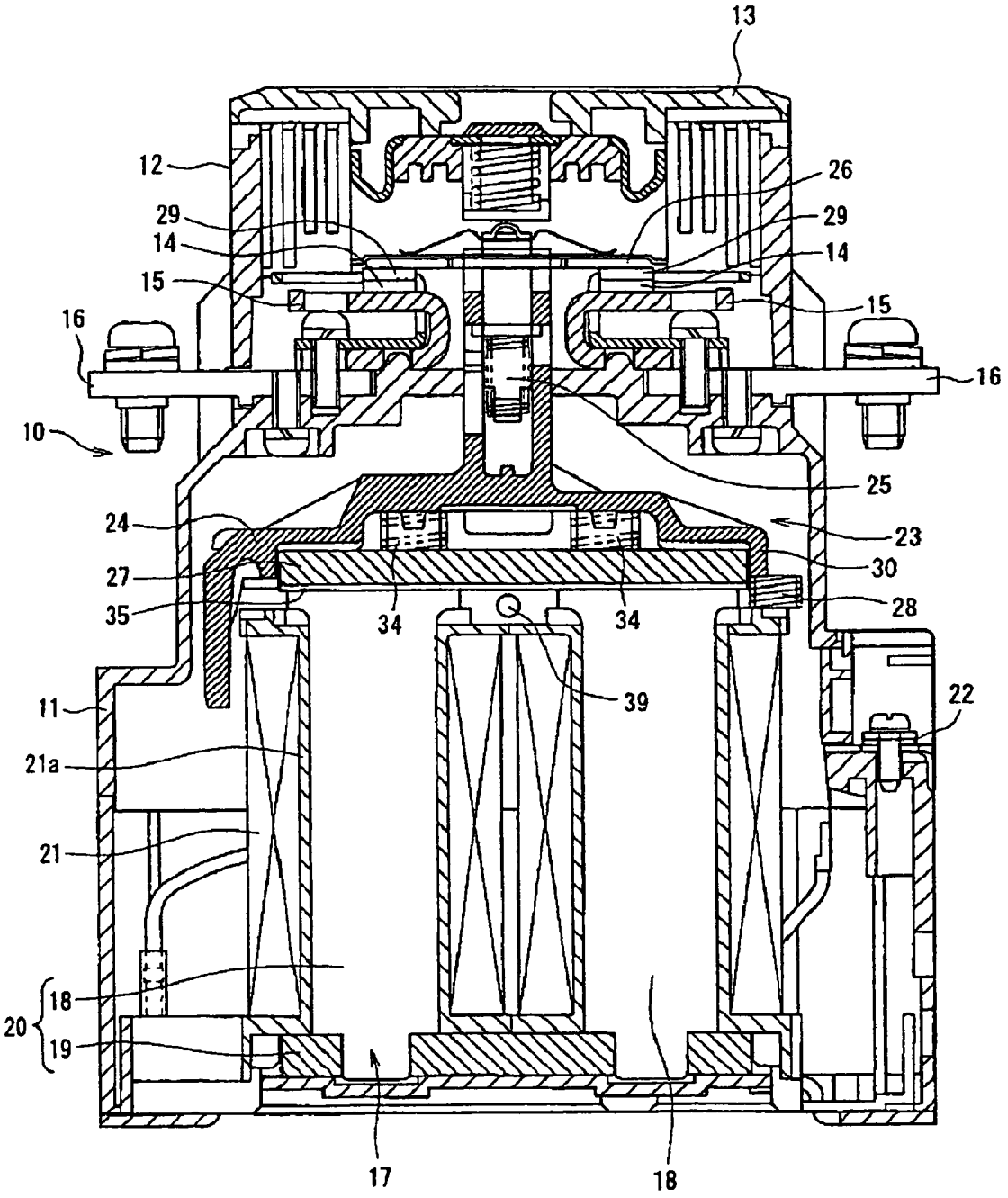
FIG. 2 is a cross sectional view showing the embodiment of the electromagnetic contactor according to the invention in an closed state.

FIG. 1 is a cross sectional view showing an electromagnetic contactor 10 as an embodiment according to the invention in an open state and FIG. 2 is a cross sectional view showing the electromagnetic contactor 10 in a closed state. Exterior structural components of the electromagnetic contactor 10 are formed of a lower case 11 of insulation material, an upper case 12 of insulation material mounted on the upper part of the lower case 11, and an arc-extinguishing cover 13 of insulation material mounted on the upper case 12 so as to cover the upper opening of the upper case 12.

To the upper wall of the lower case 11, a plurality of pairs of stationary contactors 15 and terminal blocks 16 are secured with the terminal blocks 16 taken out of the lower case 11. Over each of the stationary contactors 15, stationary contacts 14 are provided. By mounting the upper case 12 over the lower case 11, the stationary contacts 14 are contained in the inner space of the upper case 12. In the lower space of the lower case 11, an electromagnet 17 is contained.

The electromagnet 17 is provided with a stationary core 20, two coils 21 and a movable core 27 that will be explained later. The stationary core 20 is formed of two main legs 18 and a yoke 19 joined to the bottom ends of the main legs 19. The two coils 21 are wound around their respective bobbins 21*a* respectively surrounding the two main legs 18. The end of the lead from the coils 21 is electrically connected to a coil terminal strip 22 provided outside of the lower case 11.

In addition, in the upper space of the lower case 11 and in the inner space of the upper case 12, a contact section 23 is contained.

The contact section 23 is provided with a movable holder 24, movable contactors 26, movable contacts 29, the movable core 27 of the electromagnet 17 and a return spring 28. The movable holder 24 is movable up and down while being guided by a rectangular guide opening 11*a* provided through the upper wall of the lower case 11 toward the inside of the lower case 11. The movable contactors 26 are coupled to the upper part of the movable holder 24 to face the stationary contactors 15 from above. The movable contacts 29 are provided on the movable contactors 26 in their respective positions opposite to the stationary contacts 14. The movable core 27 of the electromagnet 17 is coupled to the lower part of the movable holder 24 to face the top end face of the stationary core 20 from above. The return spring 28 is arranged between the top end of the coil 21 and the movable holder 24.

Moreover, the return spring 28 always applies the movable holder 24 an upward resilient force of separating the movable holder 24 from the stationary core 20. Along with this, in the movable holder 24, a contact spring 25 is provided for applying an upward resilient force to the movable holder 24 moving downward.

Figure 3:
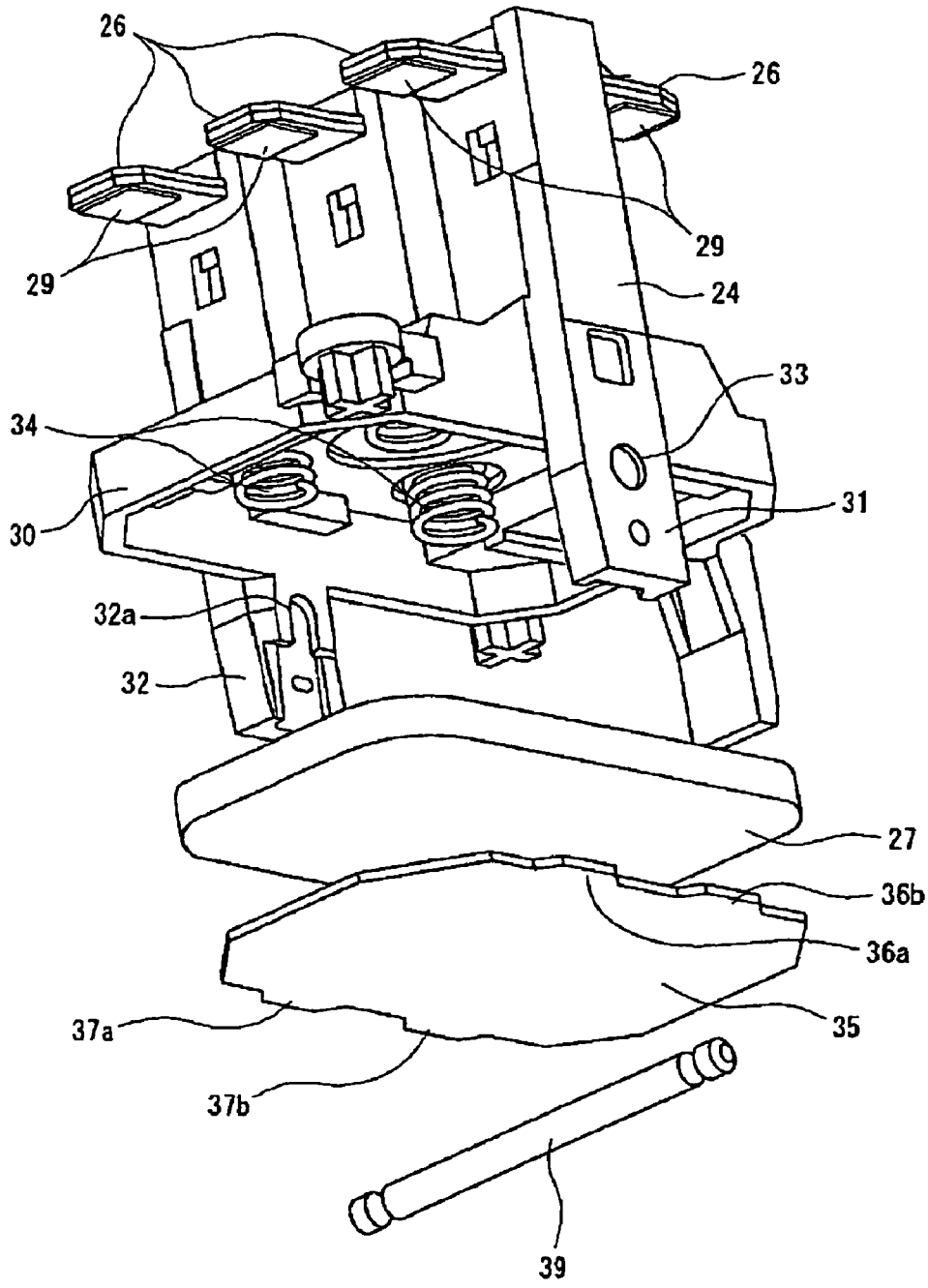
FIG. 3 is an exploded perspective view showing structural components for coupling a movable core and a nonmagnetic structural component onto the bottom of a movable holder in the embodiment of the electromagnetic contactor according to the invention.
Figure 4:
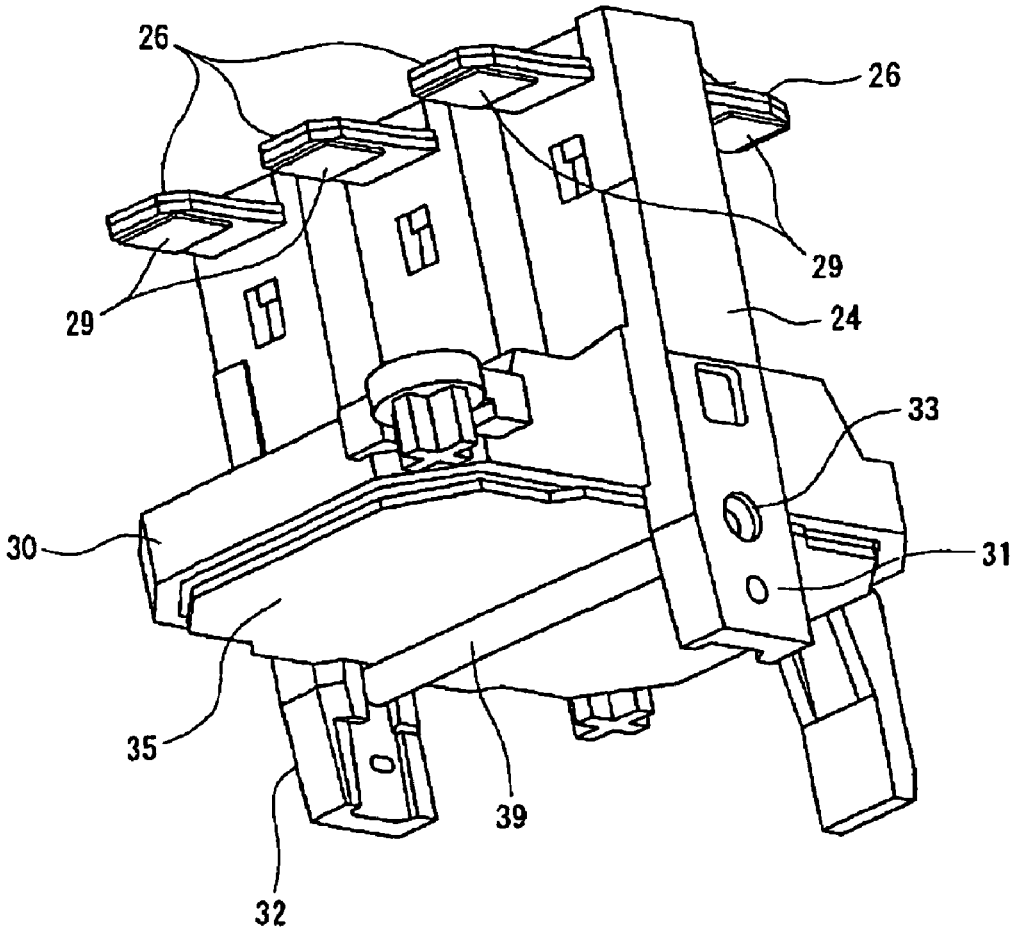
FIG. 4 is a perspective view showing the movable core and the nonmagnetic structural component coupled onto the bottom of the movable holder in the embodiment of the electromagnetic contactor according to the invention.
Figure 5:
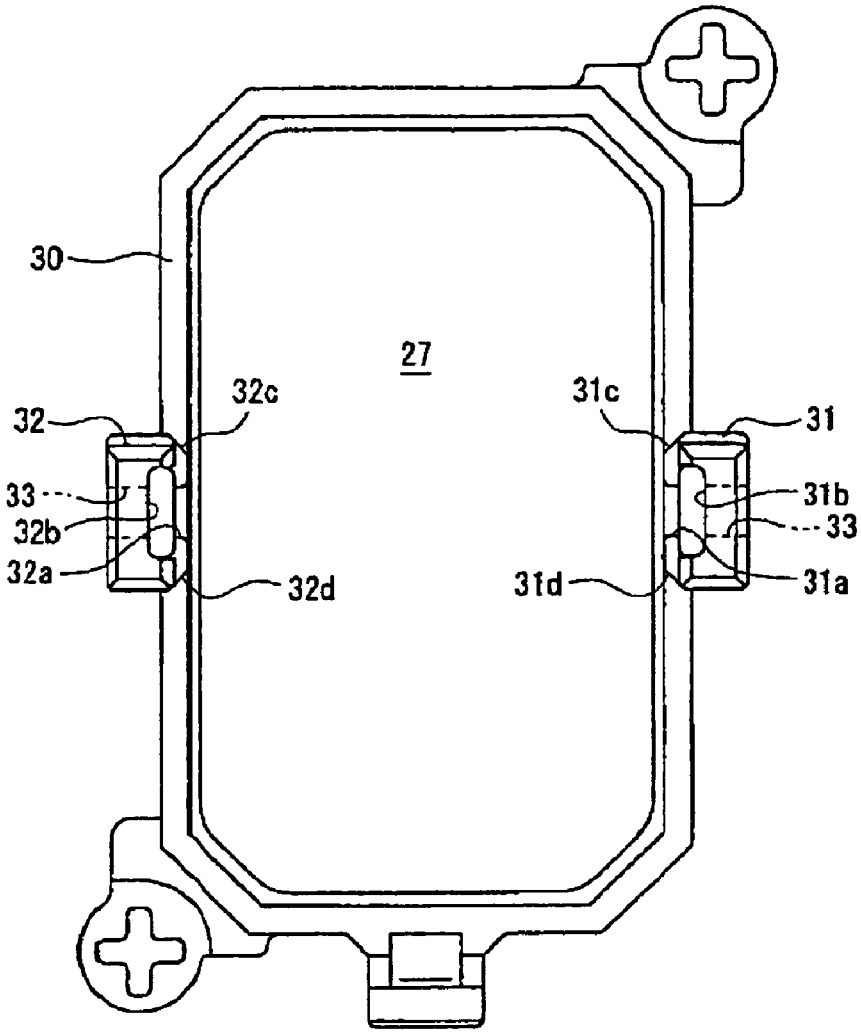
FIG. 5 is a bottom plan view showing the movable core arranged on the bottom of the movable holder in the embodiment of the electromagnetic contactor according to the invention.
Figure 6:
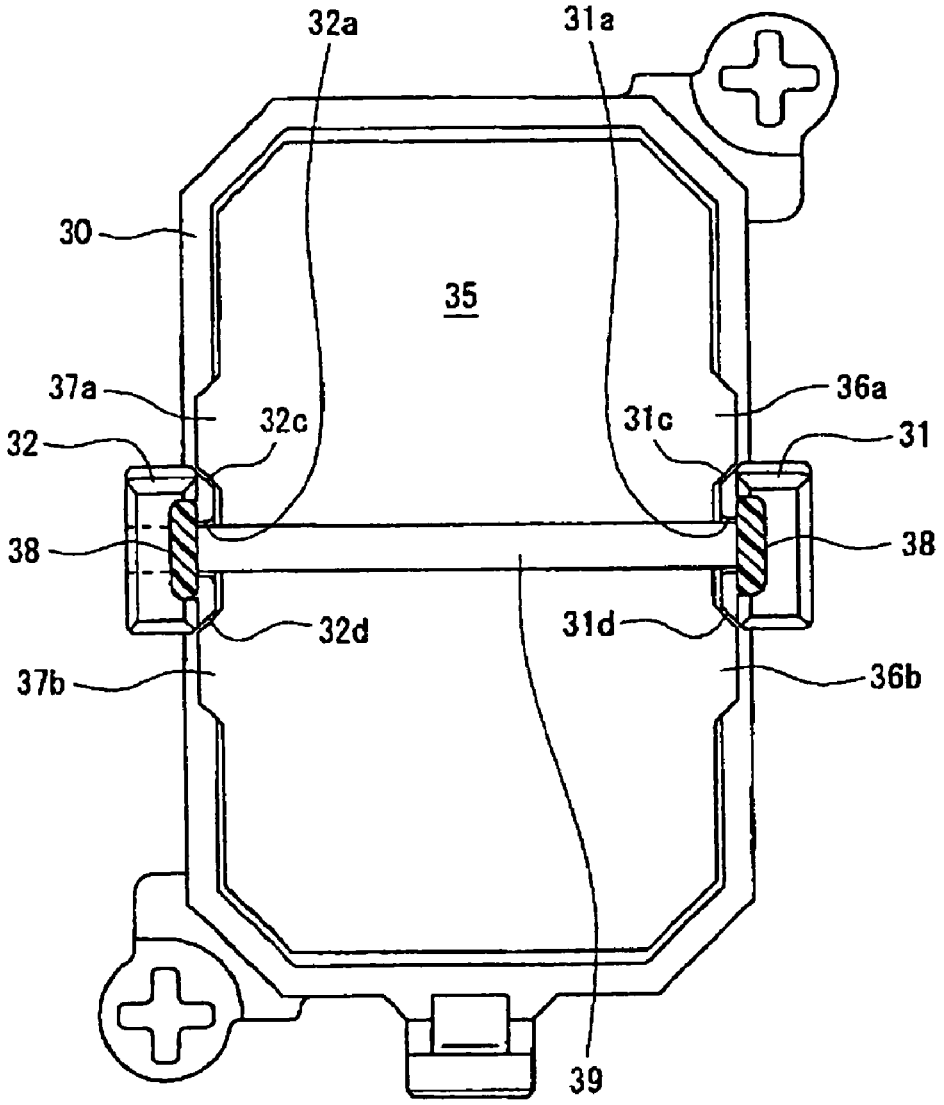
FIG. 6 is a bottom plan view showing the nonmagnetic structural component coupled to the bottom of the movable holder in the embodiment of the electromagnetic contactor according to the invention.
Figure 7A:
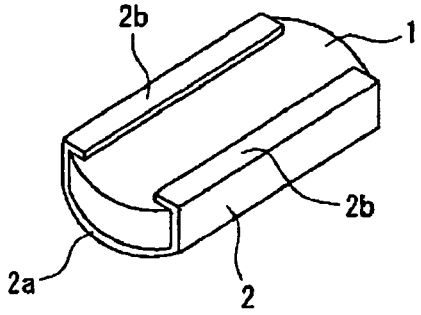
Fig. 7A Prior Art
FIGS. 7 A to 7C are perspective views each showing a structure of coupling a movable core and a nonmagnetic structural component in a related electromagnetic contactor.
Figure 7B:
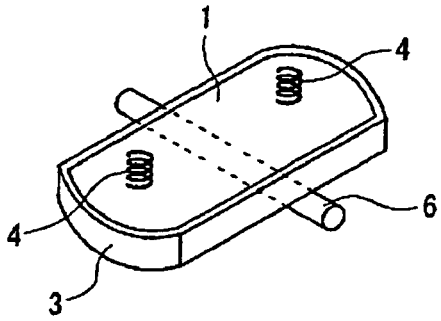
Fig. 7B Prior Art
Figure 7C:
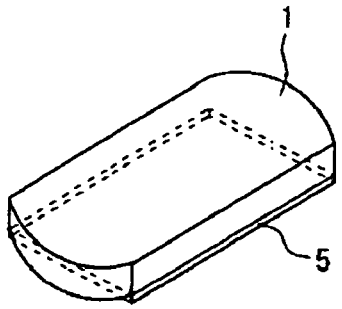
Fig. 7C Prior Art

FIG. 3 is an exploded perspective view showing structural components for coupling the movable core 27 and a nonmagnetic plate 35 onto the bottom of the movable holder 24 in the electromagnetic contactor 10 as the embodiment according to the invention, FIG. 4 is a perspective view showing the movable core 27 and the nonmagnetic plate 35 coupled onto the bottom of the movable holder 24 in the electromagnetic contactor 10 as the embodiment according to the invention, FIG. 5 is a bottom plan view showing the movable core 27 arranged on the bottom of the movable holder 24 in the electromagnetic contactor 10 as the embodiment according to the invention and FIG. 6 is a bottom plan view showing the nonmagnetic plate 35 coupled to the bottom of the movable holder 24 in the electromagnetic contactor 10 as the embodiment according to the invention.

As shown in FIG. 3 and FIG. 5, in the lower part of the movable holder 24, there are formed a rectangular frame 30 and a pair of holder legs 31 and 32. The frame 30 is formed to surround the periphery and the upper face of the movable core 27 with an external shape of an approximately rectangular plate. A pair of the holder legs 31 and 32 is formed so as to project downward from the middle parts of a pair of the long sides of the frame 30, respectively.

A pair of the holder legs 31 and 32 has on their inner wall sides engaging indentations 31*a* and 32*a*, respectively, formed, each being cut in a U shape to which the periphery of each end of a coupling pin 39 of a solid cylindrical structural component is made fitted. The holder legs 31 and 32 further have circular pin insertion openings 33 formed in their outer walls to the engaging indentation 31*a* and 32*a*, respectively. In addition, a pair of the holder legs 31 and 32 have stopper attaching spaces 31*b* and 32*b* formed, respectively, the bottom ends of which spaces are made opened.

Moreover, as shown in FIG. 3, within the frame 30, cushioning springs 34 are arranged which butt against the upper face of the movable core 27. The nonmagnetic plate 35 is overlaid on the bottom face of the movable core 27. The movable core 27, on which the nonmagnetic plate 27 is overlaid, is supported with the coupling pin 39, inserted from the pin insertion opening 33 in either of the holder legs 31 or 32, made engaged with the engaging indentations 31*a* and 32*a* to be provided between a pair of the holder legs 31 and 32. Thus, the movable core 27 and the nonmagnetic plate 35 are coupled to the bottom of the movable holder 24 while being held between the cushioning springs 34 and the coupling pin 39 provided across the approximately middle part of the bottom face of the nonmagnetic plate 35 (see FIG. 4). Into each of the above-explained stopper attaching spaces 31*b* and 32*b* provided in a pair of the holder legs 31 and 32, respectively, as shown in FIG. 6, a stopper 38 of elastic structural material such as rubber is fitted, for preventing the coupling pin 39 from falling off.

The nonmagnetic plate 35 is a flat plate structural component made of nonmagnetic metal such as brass, phosphor bronze or stainless steel or rigid plastic, having a thickness that can prevent the movable core 27 from being attracted to the stationary core 20 by residual magnetism due to magnetization retained in the stationary core 20 and having high flexural rigidity. The nonmagnetic plate 35 is formed into a plate with a rectangular shape approximately the same as the shape of the bottom face of the movable core 27 (see FIG. 5).

As shown in FIG. 6, a guide is provided in the middle section of each of a pair of long sides of the nonmagnetic plate 35 according to the embodiment. The guide surrounds the inner wall side of each of a pair of the holder legs 31 and 32 to thereby restrict the relative shift of the whole nonmagnetic plate 35 to a pair of the holder legs 31 and 32. That is, the nonmagnetic plate 35 has a pair of protrusions 36*a* and 36*b* formed on its long side on the side of the holder leg 31 and a pair of protrusions 37*a* and 37*b* formed on its long side on the side of the holder leg 32. The protrusions 36*a* and 36*b* surround an inner wall 31*c* on the left side of the engaging indentation 31*a* of the holder leg 31 and an inner wall 31*d* on the right side of the engaging indentation 31*a* with a slight clearance provided from the inner walls 31*c* and 31*d*, respectively. Moreover, the protrusions 37*a* and 37*b* surround an inner wall 32*c* on the right side of the engaging indentation 32*a* of the holder leg 32 and an inner wall 32*d* on the left side of the engaging indentation 32*a* with a slight clearance provided from the inner walls 32*c* and 32*d*, respectively. A section in which a pair of the protrusions 36*a* and 36*b* are in close proximity to the inner walls 31*c* and 31*d* corresponds to the above described guide and a section in which a pair of the protrusions 37*a* and 37*b* are in close proximity to the inner walls 32*c* and 32*d* corresponds to the above described guide In the next, an explanation will be made about the operation of the electromagnetic contactor 10 according to the embodiment with reference to FIG. 1 and FIG. 2.

A plurality of terminal blocks 16 shown in FIG. 1 and FIG. 2 is electrically connected to an un-illustrated power supply and electric load devices in a main circuit.

In an open (OFF) state shown in FIG. 1, there is no continuity between each of a plurality of pairs of the stationary contactors 15. In this state, excitation of the coil 21 of the electromagnet 17, attracts the movable core 27 to the top end face of the main leg 18 of the stationary core 20 with the magnetic attractive force acting between the movable core 27 and the stationary core 20 overcoming the resilient force of the return spring 28. Therefore, as shown in FIG. 2, the movable holder 24 shifts downward, by which the nonmagnetic plate 35 arranged on the bottom face of the movable core 27 butts against the top end face of the main leg 18. This induces the movable contactors 26 to shift downward and bring the movable contacts 29 into contact with the stationary contacts 14 with the contact spring 25 being compressed. Thus, a plurality of pairs of the stationary contactors 15 are short-circuited through the movable contactors 26 to bring the electromagnetic contactor 10 into a closed (ON) state.

Next to this, interruption of excitation of the coil 21 of the electromagnetic contactor 10 in the closed (ON) state allows the movable core 27 to shift upward by the resilient force of the return spring 28. At the same time, the movable contactors 26 coupled to the upper part of the movable holder 24 shift upward to separate the movable contacts 29 from the stationary contacts 14 to open the contacts.

Here, even though the excitation of the coil 21 is interrupted, there exists residual magnetism due to magnetization retained in the stationary core 20. Nevertheless, the nonmagnetic plate 35 provided between the stationary contact 20 (the top end face of the main leg 18) and the movable core 27, reduces the attractive force acting the movable core 27 due to the residual magnetism. Therefore, only under the influence of the resilient force of the return spring 28, is the movable core 27 shifted upward.

Following this, an explanation will be made about the operations and working-effects of structural components forming the electromagnetic contactor 10 according to the embodiment.

The nonmagnetic plate 35 in the embodiment is a flat plate structural component overlaid on the bottom face of the movable core 27. This allows the unit price of the nonmagnetic plate 35 to be set lower compared with that of the related nonmagnetic plates with complicated shapes, which can reduce the product cost of the electromagnetic contactor 10.

In addition, the nonmagnetic plate 35 overlaid on the bottom face of the movable core 27 of the embodiment forms a structure in which the nonmagnetic plate 35 is held together with the movable core 27 between the cushioning spring 34 butting against the top face of the movable core 27 and the coupling pin 39 provided across the nonmagnetic plate 35 with both ends of the pin 39 made engaged with a pair of the holder legs 31 and 32, respectively. This eliminates the need of sticking the nonmagnetic plate 35 onto the movable core 27 to reduce the man-hours of work required for assembling the electromagnetic contactor 10, which enables reduction in product cost of the electromagnetic contactor 10.

Moreover, an impactive force, exerted on the nonmagnetic plate 35 when the nonmagnetic plate 35 butts against the top end face of the main leg 18 of the stationary core 20 with the movable core 27 attracted to the stationary core 20, also acts in the direction along the bottom face of the movable core 27. Under normal circumstances, this generally causes the nonmagnetic plate 35 without being stuck onto the movable core 27, to shift in the direction along the bottom face of the movable core 27 and repeat collisions with the frame 30 of the movable holder 24 and a pair of the holder legs 31 and 32. The collisions result in possible wear or damage of the frame 30 and a pair of the holder legs 31 and 32. However, the nonmagnetic plate 35 according to the embodiment has guides formed each of which surround the inner wall sides of a pair of the holder legs 31 and 32, respectively, with a slight clearance provided from each of the inner walls to thereby restrict the relative shift of the whole nonmagnetic plate 35 with respect to the pair of the holder legs 31 and 32. The guides are provided in the part where a pair of the protrusions 36*a* and 36*b* are in close proximity to the inner walls 31*c* and 31*d*, respectively, and in the part where a pair of the protrusions 37*a* and 37*b* are in close proximity to the inner walls 32*c* and 32*d*, respectively. The guides restrict the shift of the nonmagnetic plate 35 to the sides of the frame 30 and a pair of the holder legs 31 and 32 to prevent the nonmagnetic plate 35 from colliding with the frame 30 and a pair of the holder legs 31 and 32, by which the wear or damage of the frame 30 and a pair of the holder legs 31 and 32 can be inhibited.

The shift restriction parts, for restricting the shift of the nonmagnetic plate 35 to the frame 30 and a pair of the holder legs 31 and 32, are not limited to the parts of a pair of the protrusions 36*a* and 36*b* and a pair of the protrusions 37*a* and 37*b* as in this embodiment, but can be parts with other shapes only requiring processing of the edges of the nonmagnetic plate 35 provided as a flat plate structural component.

The disclosure of Japanese Patent Application No. 2009-081727 filed on Mar. 30, 2009 is incorporated herein as a reference.

While the present invention has been particularly shown and described with reference to the preferred embodiments thereof, it will be understood by those skilled in the art that the foregoing and other changes in form and details can be made therein without departing from the spirit and scope of the present invention.

What is claimed is:

1. An electromagnetic contactor, comprising:

a stationary core;

a coil arranged around the stationary core;

a movable holder arranged movably toward the stationary core and having a pair of holder legs respectively provided on a side facing the stationary core;

a movable core coupled to one end of the movable holder in proximity to the stationary core for being attracted to the stationary core by an excitation of the coil; and a nonmagnetic structural component arranged on the movable core on the side facing the stationary core, wherein the nonmagnetic structural component is a flat plate with flexural rigidity, and is arranged to be overlaid on a surface of the movable core facing the stationary core, and the nonmagnetic structural component and the movable core are held between a cushioning spring and a coupling pin, the cushioning spring being contained in the movable holder and abutting against a back face of the movable core not facing the stationary core, and the coupling pin being arranged across the nonmagnetic structural component with both ends engaging with the pair of holder legs, respectively, wherein the nonmagnetic structural component includes guides for restricting shifting of the nonmagnetic structural component relative to the holder legs of the movable holder along the surface of the movable core, and wherein each of the guides is formed as a pair of protrusions protruding from an edge of the nonmagnetic structural component to sandwich one of the holder legs between the pair of protrusions, and the pair of protrusions has a clearance with respect to the holder leg facing thereto.

2. An electromagnetic contactor, comprising:

a stationary core;

a coil arranged around the stationary core;

a movable holder arranged movably toward the stationary core and having a pair of holder legs respectively provided on a side facing the stationary core;

a movable core coupled to one end of the movable holder in proximity to the stationary core for being attracted to the stationary core by an excitation of the coil; and a nonmagnetic structural component arranged on the movable core on the side facing the stationary core, wherein the nonmagnetic structural component is a flat plate with flexural rigidity, and is arranged to be overlaid on a surface of the movable core facing the stationary core, and the nonmagnetic structural component and the movable core are held between a cushioning spring and a coupling pin, the cushioning spring being contained in the movable holder and abutting against a back face of the movable core not facing the stationary core, and the coupling pin being arranged across the nonmagnetic structural component with both ends engaging with the pair of holder legs, respectively, and wherein the movable holder further includes a frame sandwiched between the pair of holder legs and facing the stationary core to house the nonmagnetic structural component and the movable core therein, said pair of holder legs having a width less than that of the frame and extending downwardly beyond the frame.

3. The electromagnetic contactor according to claim 2, wherein each of the pair of holder legs has an indentation at an inner wall, extending upwardly from one end thereof facing the stationary core.

4. The electromagnetic contactor according to claim 3, wherein the indentation includes a U-shaped portion at the other end thereof to fit the coupling pin therein.

5. The electromagnetic contactor according to claim 4, wherein the coupling pin has pin indentations at two ends thereof.

6. The electromagnetic contactor according to claim 5, further comprising stoppers provided on the coupling pin at the two ends for preventing the coupling pin from falling off.

7. The electromagnetic contactor according to claim 6, wherein the movable core is directly supported on the nonmagnetic structural component.

* * * * *